US007942352B2

(12) United States Patent
Matlin et al.

(10) Patent No.: US 7,942,352 B2
(45) Date of Patent: May 17, 2011

(54) SHREDDER WITH ROTATABLE DEVICE FOR MOVING SHREDDED MATERIALS ADJACENT THE OUTLET

(75) Inventors: Tai Hoon Kim Matlin, Round Lake Beach, IL (US); Jakub M. Krynski, Buffalo Grove, IL (US)

(73) Assignee: Fellowes, Inc., Itasca, IL (US)

( * ) Notice: Subject to any disclaimer, the term of this patent is extended or adjusted under 35 U.S.C. 154(b) by 185 days.

(21) Appl. No.: 12/314,182

(22) Filed: Dec. 5, 2008

(65) Prior Publication Data

US 2010/0140383 A1 Jun. 10, 2010

(51) Int. Cl.
*B02C 18/22* (2006.01)

(52) U.S. Cl. ..... 241/30; 241/33; 241/100; 241/167; 241/236

(58) Field of Classification Search ..... 241/236, 241/100, 30, 166, 167, 33
See application file for complete search history.

(56) References Cited

U.S. PATENT DOCUMENTS

| | | | | |
|---|---|---|---|---|
| 1,085,975 | A * | 2/1914 | Dilg | 241/238 |
| 1,706,935 | A * | 3/1929 | Milne | 241/167 |
| 7,150,422 | B2 | 12/2006 | Wang | |
| 2007/0029542 | A1 | 2/2007 | Yamada | |
| 2007/0295736 | A1 | 12/2007 | Wang | |
| 2008/0041988 | A1 | 2/2008 | Wang | |
| 2008/0156914 | A1 | 7/2008 | Huang | |

FOREIGN PATENT DOCUMENTS

| | | |
|---|---|---|
| JP | 8-1027 | 1/1996 |
| JP | 2002-239405 | 8/2002 |
| JP | 2004-321993 | 11/2004 |

* cited by examiner

*Primary Examiner* — Mark Rosenbaum
(74) *Attorney, Agent, or Firm* — Pillsbury Winthrop Shaw Pittman LLP

(57) ABSTRACT

Disclosed herein is a shredder having a rotatable device located at least partially between a shredder mechanism and a bottom of an output opening of the shredder housing. The rotatable device includes a shaft configured to rotate about an axis parallel to an axis of the cutting assembly so as to allow for rotation of the device. The rotatable device has a plurality of fingers or fins extending at least partially radially from the shaft. The rotatable device is able to rotate about the shaft axis in either direction, so as to disperse any accumulation of shredded materials in the waste bin, as well as remove shredded materials caught in or near the cutting assembly within and adjacent the output opening.

57 Claims, 7 Drawing Sheets

SHREDDER WITH ROTATABLE DEVICE FOR MOVING SHREDDED MATERIALS ADJACENT THE OUTLET

BACKGROUND

1. Field of Invention

The present invention is generally related to shredders for destroying articles, such as documents, CDs, etc. More specifically, the present invention is related to shredders including a rotatable device for moving shredded materials in a shredder.

2. Description of Related Art

During operation of a shredder, paper or other articles are fed through the input opening or throat of the shredder to be destroyed. As shown in FIG. 1, when paper is fed through a throat 101 of shredder 100, the paper travels into a cutting assembly 102 where it is shredded into smaller particles. The particles then exit through an outlet 104 of housing 105, and accumulate inside waste bin 103. However, problems may develop at or near the outlet 104 of the shredder 100, which may affect proper operation of the shredder.

One problem which may develop during shredding of articles includes when shredded particles adhere to or near the cutting assembly 102 or outlet 104 of the shredder 100. Such a phenomenon of accumulated particles known as "bird nesting," as indicated by element 120. The shredded particles may accumulate due to physical or electrostatic means, for example. Over time, bird nesting particles 120 that accumulate near outlet 104 can become lodged inside the cutting assembly 102 or outlet 104 and reduce the sheet capacity (i.e., the amount of articles to be received and shredded in the cutting assembly) of the machine. Thus, extra strain may be placed on the gears, bearings, and motor (not shown) associated with the cutting assembly, and may even damage the cutting assembly 102. It is therefore desirable to reduce bird nesting particles 120 in order to extend the life and efficiency of a shredder 100 and maintain proper operation. This problem occurs more often in cross-cutting shredders, because the small chips formed by cross-cutting are more likely to accumulate.

Additionally, after articles have been shredded and particles descend from the housing 105, a second problem may develop. As shredded particles collect inside the waste bin 103, the shredded particles tend to accumulate in a shape similar to a peak or mountain, sometimes also referred to as "crowning," as indicated by element 130. An accumulation of crowing particles 130 is inefficient since the particles will quickly build up. The crowning particles 130 may then perhaps start pushing against the cutting assembly 102, possibly contributing to the accumulation of bird nesting particles 120. The crowning particles 130 may also falsely or prematurely trigger a bin full detection system before the waste bin 103 is completely full. User assistance may then be required to either empty the waste bin 103, remove shreds that have accumulated near the output opening or cutting assembly, or to even out the pile of particles by hand before continuing to shred. Such assistance may not only be time consuming, but also dangerous. It is therefore desirable for a shredder to have particles which accumulate evenly in the waste bin 103, particularly in shredders that utilize a bin full detection system.

Some prior art methods have attempted to develop devices to curb such problems. For example, U.S. Patent Application 2008/0041988 A1 describes a brush-off device that slides reciprocally along shafts of a cutter assembly in an axial direction. However, the prior art fails to provide a feature for cleaning an underside of the cutting assembly or outlet. Rather, the prior art functions below the shredder housing.

To prevent crowning, the prior art, such as U.S. Patent Applications 2007/029542 A1 and 2007/0295736 A1, describes shredders having containers or bins that are rocked to prevent build up of particles. U.S. Pat. No. 7,150,422 B2 provides a manual device for pressing paper downwardly in the bin. However, none of the prior art devices are designed to operate inside or with the shredder housing to clear particles caught in the cutter elements of the cutter assembly, as well as assist in preventing crowning in the bin.

SUMMARY

One aspect of the invention provides a shredder including a bin for receiving shredded materials and a shredder housing having a shredder mechanism mounted therein. The shredder housing is provided on the bin and includes an input opening for receiving materials and an output opening for depositing shredded material into the bin. The shredder mechanism includes a motor and a cutter assembly; the motor rotates the cutter assembly about an axis to shred materials fed therein. The shredder also includes a rotatable device positioned adjacent the output opening. The rotatable device has a shaft with a plurality of fingers extending at least partially radially from the shaft. The shaft is configured to rotate about a parallel axis adjacent the axis of the cutter elements to move shredded materials adjacent the output opening.

In an embodiment, the fingers of the rotatable device extend into the cutter assembly so as to move shredded materials caught in or around the cutter assembly adjacent the output opening. In an embodiment, the fingers of the rotatable device extend at least partially into the bin to move an accumulation of shredded materials in the bin. Thus, the shredded materials adjacent the output opening could be either or both the materials in the cutter assembly or the materials in the bin.

Another aspect of the invention provides a method for moving shredded materials in a shredder. The method includes: feeding material to be shredded into an input opening in a shredder housing of the shredder, the shredder housing being provided on a bin for receiving shredded materials; and shredding the material with a shredder mechanism mounted in the shredder housing. The shredder mechanism includes a motor and a cutter assembly, and the motor rotates the cutter assembly about an axis to shred materials fed therein. The method also includes depositing the shredded material via an output opening in the shredder housing into the bin; and rotating a shaft of a rotatable device about a parallel axis that is adjacent the axis of the cutter elements. The shaft of the rotatable device has a plurality of fingers extending at least partially radially from the shaft to move shredded material adjacent the output opening. The rotatable device is positioned adjacent the output opening. In an embodiment, the fingers of the rotatable device extend into the cutter assembly so as to move shredded materials caught in or around the cutter assembly adjacent the output opening. In an embodiment, the fingers of the rotatable device extend at least partially into the bin to move an accumulation of shredded materials in the bin. Also, in an embodiment, the method includes detecting a presence of shredded materials in relation to the rotatable device and activating the rotation of the shaft of the rotatable device upon the detection of the presence of shredded materials.

Other objects, features, and advantages of the present invention will become apparent from the following detailed description, the accompanying drawings, and the appended claims.

DETAILED DESCRIPTION OF THE PREFERRED EMBODIMENT(S)

The described devices herein are designed to resolve or alleviate one or more of the above-noted problems found in conventional paper shredders; specifically, where particles accumulate unevenly in the waste bin, where shredded materials or paper particles become stuck to a bottom of the shredder housing and cutting assembly, and/or when bin full detection systems inaccurately detect a full bin due to accumulation or piling of shredded materials or the materials attached to the shredder housing.

Figure 2:
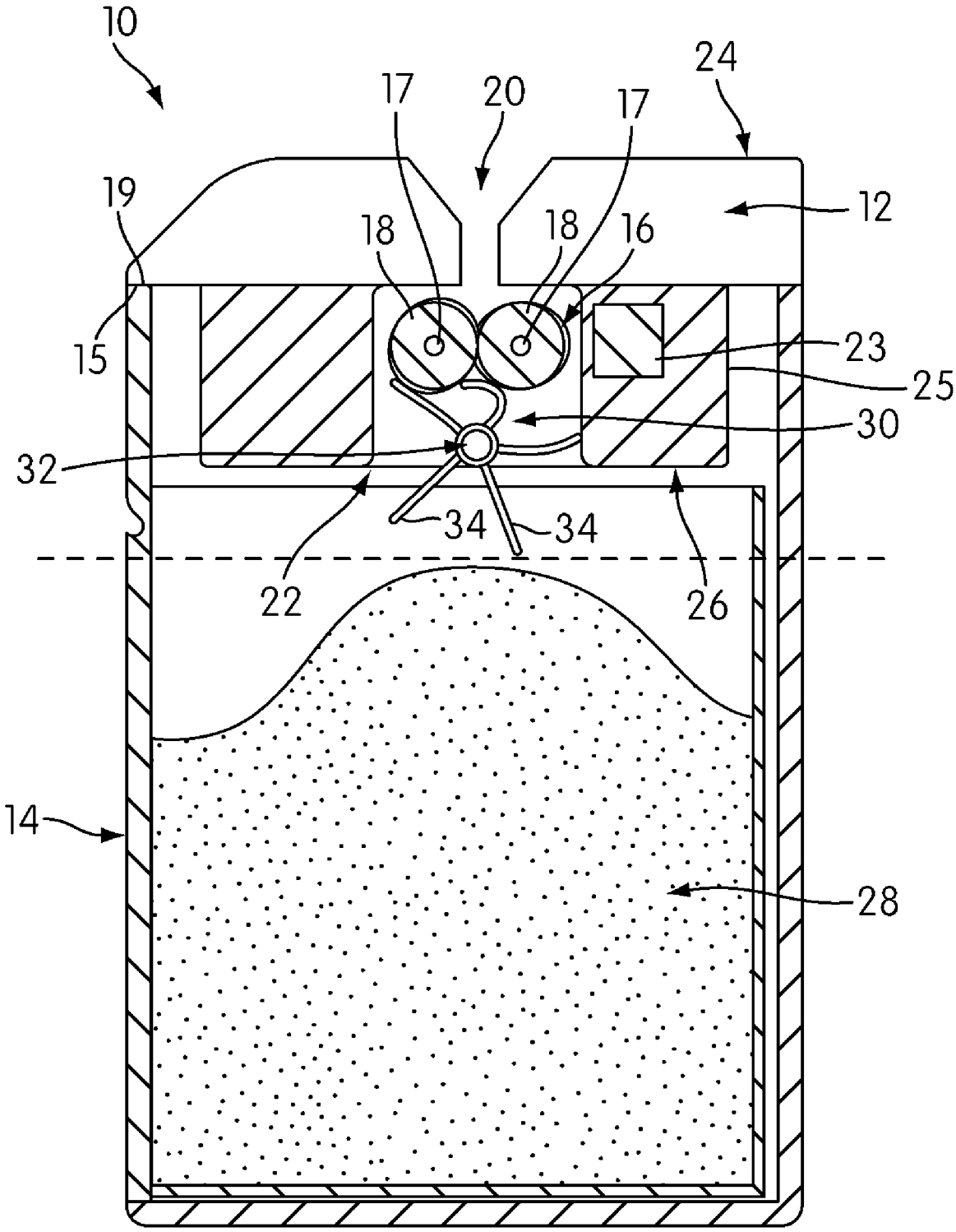
FIG. 2 is a cross-sectional view of a shredder having a rotatable device in accordance with an embodiment of the present invention.

Referring now more particularly to the drawings, FIG. 2 is a cross-sectional view of a shredder 10 in accordance with an embodiment of the present invention. The shredder 10 is designed to destroy or shred articles such as paper and/or disks (e.g., CDs). In an embodiment, the shredder 10 may comprise wheels (not shown) to assist in moving the shredder 10. The shredder 10 comprises a shredder housing 12 that sits on top of a container or bin 14, for example. The shredder housing 12 comprises at least one input opening 20 on an upper side 24 (or upper wall or top side or top wall) of the housing 12 for receiving materials to be shredded. The input opening 20 may generally extend in a lateral direction, and is also often referred to as a throat. The input opening 20 or throat may extend generally parallel to and above a shredder mechanism 16 (described below). The input opening or throat 20 may be relatively narrow, so as to prevent overly thick items, such as large stacks of documents, from being fed therein. However, throat 20 may have any configuration. In an embodiment, an additional or second input opening (not shown) may be provided in shredder housing 12. For example, throat 20 may be provided to receive paper, paper products, and other items, while second input opening (not shown) may be provided to receive objects such as CDs and DVDs.

Shredder housing 12 also comprises an output opening 22 or outlet on a lower side 26 (or bottom side or bottom wall or underside or bin side). In an embodiment, shredder housing 12 may include a bottom receptacle 25 to receive shredder mechanism 16 therein. Bottom receptacle 25 may include output opening or outlet 22 in its lower side 26 through which shredded material is deposited into the bin 14. The bottom receptacle 25 and/or outlet 22 may reside within the opening of the bin 14 so as to direct shredded particles into the bin. Generally speaking, the shredder 10 may have any suitable construction or configuration and the illustrated embodiments provided herein are not intended to be limiting in any way.

As noted, the shredder 10 also comprises a shredder mechanism 16 in the housing 12. When articles are inserted into the at least one input opening or throat 20, they are directed toward and into shredder mechanism 16. "Shredder mechanism" is a generic structural term to denote a device that destroys articles using at least one cutter element. Destroying may be done in any particular way. Shredder mechanism 20 includes a drive system with at least one motor 23, such as an electrically powered motor, and a cutter assembly comprising a plurality of cutter elements 18. The cutter elements 18 of cutter assembly are mounted on a pair of parallel mounting shafts 17. Typically, the cutter elements will be designed for cross-cutting (i.e., for shredding the article into small chips). See, e.g., U.S. Pat. No. 6,260,780 to Kroger et al., the entirety of which is incorporated herein by reference.

The motor 23 operates using electrical power to rotatably drive the mounting shafts 17 of the shredder mechanism 16 and their corresponding cutter elements 18 through a conventional transmission (not shown) so that the cutter elements 18 shred or destroy articles fed therein, and, subsequently, deposit the shredded materials into bin 14 via the outlet 22. The shafts 17 are mounted in relation to the throat and may be provided on lateral axes A1 and A2, respectively. The shafts 17 are configured to rotate about axes A1 and A2 so as to rotate the cutter elements 18 of the cutter assembly for shredding. In an embodiment, the shredder mechanism 16 may also include a sub-frame for mounting the shafts, motor, and transmission. The drive system may have any number of motors and may include one or more transmissions. Also, the plurality of cutter elements 18 are mounted on the rotatable mounting shafts 17 in any suitable manner. For example, in an embodiment, cutter elements 18 are rotated about axes A1 and A2 in an interleaving relationship for shredded paper sheets or other articles fed therein. In an embodiment, the cutter elements 18 may be provided in a stacked relationship. The operation and construction of such a shredder mechanism 16 is well known and need not be discussed herein in detail. As such, the at least one input opening or throat 20 is configured to receive materials inserted therein to feed such materials through the shredder mechanism 16 and to deposit or eject the shredded materials through output opening or outlet 22.

The bin 14 receives shredded materials or articles from the shredder mechanism 16 of the shredder 10. The bin 14 comprises a bottom wall, four side walls, and a top, for example. Generally, the shredder housing 12 is configured to be seated above or upon the container 18. Shredder housing 12 may comprise a detachable paper shredder mechanism, as shown in FIG. 2. That is, in an embodiment, the shredder housing may be moved or removed in relation to the container or bin 14 to ease or assist in emptying the bin 14 of shredded materials. In an embodiment, shredder housing 12 comprises a lip 15 or other structural arrangement that corresponds in size and shape with a top edge 19 or opening of bin 14. After inserting materials into throat 20 for shredding by cutter elements 18, the shredded materials are deposited from output opening or outlet 22 on the lower side 26 of the housing 12 into the opening of the bin 14. The bin 14 may be a waste bin, for example. In some embodiments, the bin 14 may be positioned in a frame or secondary housing beneath the shredder housing 12. For example, the frame may be used to support the shredder housing 12 as well as comprise a container receiving space so that the container or bin 14 may be removed therefrom. Generally the terms "container," "waste bin," and "bin" are defined as devices for receiving shredded materials discharged from the output opening 22 of the shredder, and such terms are used interchangeably through this specification. However, such terms should not be limiting. Bin 14 may have any suitable construction or configuration.

Though not shown, a power supply to the shredder may be in the form of a standard power cord with a plug on its ends that plugs into a standard AC outlet. Generally, the use of a control panel is known in the art. For example, the upper side 24 of housing 12 may also include a power switch or plurality of switches and/or switch recess or an on/off switch. Any number of switches may be provided. A switch may be moved so as to move a switch module between states (e.g., ON, OFF), for example. For example, the switch module may communicate with a controller and a motor 23 to send (or stop) transmission of electrical signals for rotating the cutter elements 18 of the shredder mechanism 16 in a shredding direction. The switch module may also communicate so as to operate the motor 23 in a reversing manner to move the cutter elements 18 in a reversing direction, such as when there is a need to clear jams, for example. Generally, the construction and operation of switches and controllers for controlling the motor are well known and any construction for these may be used. For example, a touch screen switch, membrane switch, or toggle switch are types of switches that may be used. Also, the switch may have any number of states or signals (e.g., lights, display screen) associated therewith.

As shredder 10 is used, shredded materials (e.g., paper) are deposited/directed into bin 14. As shown in FIG. 2, as shredded materials fill the bin 14, they may form a pile 28. Also, shredded materials may accumulate near or adjacent the outlet 22 or the lower side 26 of the shredder housing 12. Shredder 10 comprises a rotatable device 30 to assist in reducing such issues. More specifically, a rotatable device 30 is provided or mounted on the lower side 26 of the shredder housing 12 to assist in moving shredded materials caught in or around the cutting assembly. Rotatable device 30 is positioned adjacent the output opening or outlet 22, as shown in FIG. 2. The rotatable device 30 is configured to move shredded materials positioned adjacent the output opening 22, as will be further described below. In some embodiments, the rotatable device 30 extends at least partially into the bin 14, so as to move shredded materials which accumulate into a pile 28 in the bin 14.

Figure 3:
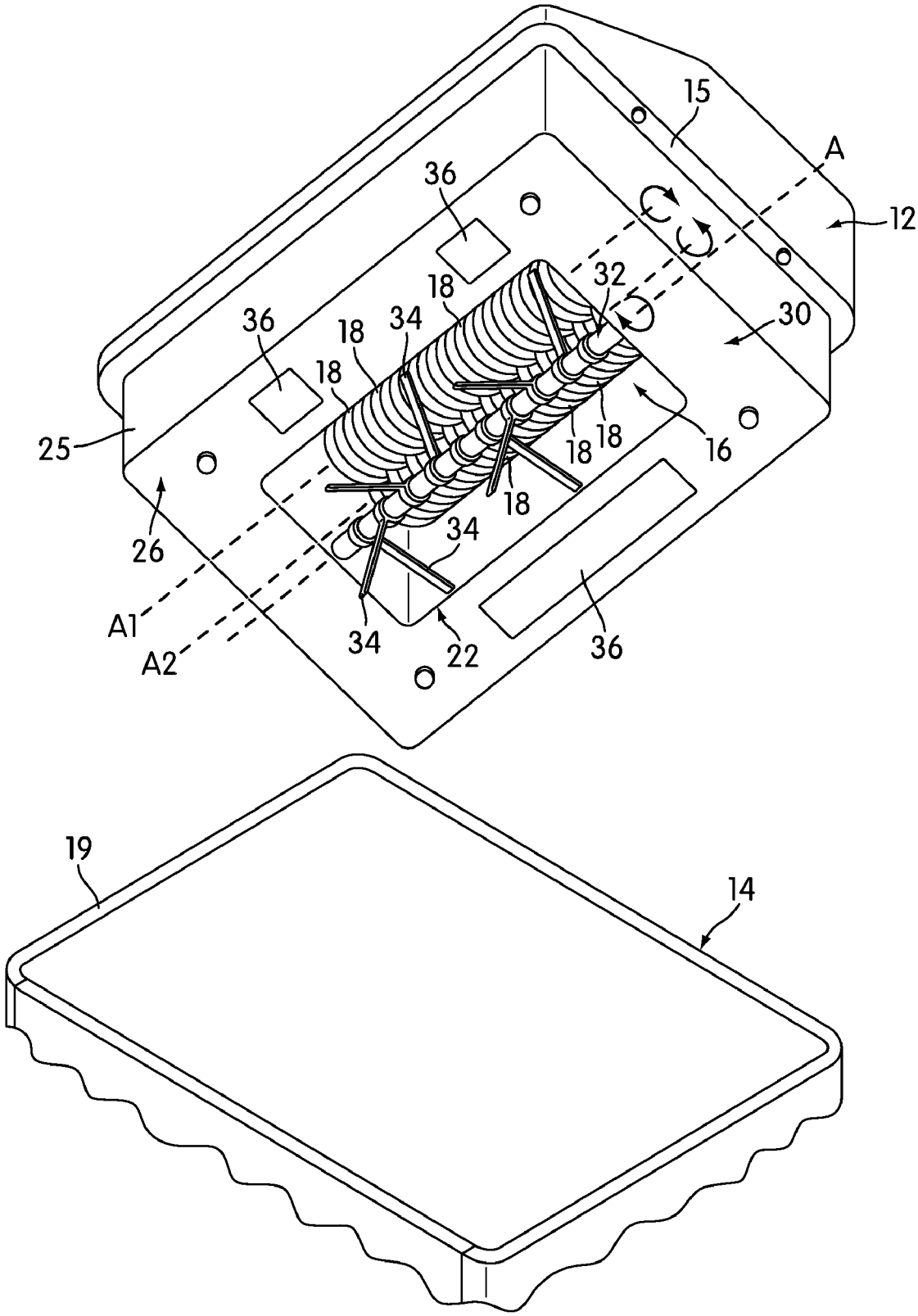
FIG. 3 is a perspective view of a lower side of a shredder housing of the shredder of FIG. 2 illustrating the rotatable device in accordance with an embodiment of the present invention.

The rotatable device 30 comprises an auxiliary shaft 32 configured to rotate about a parallel, lateral axis A adjacent the axes A1 and A2 of the cutter elements 18 of the cutter assembly. In some embodiments, the rotating shaft 32 of the rotatable device 30 may be positioned below the shredder mechanism 16, as illustrated in FIG. 3. In some embodiments, the shaft 32 is mounted within the shredder housing 12 or, alternatively, within the shredder mechanism 16. The shaft 32 may be rotated in any direction, e.g., in a clockwise direction or a counterclockwise direction. In some embodiments, the shaft 32 of the rotatable device 30 is driven by the motor 23 rotating the cutter elements 18 of the cutting assembly. In some embodiments, the shaft 32 of the rotatable device 30 is rotated by a separate motor (not shown).

As shown in greater detail in FIG. 3, the rotatable device may comprise a plurality of fingers 34 projecting from a surface 33 of shaft 32 in a perpendicular direction in relation to the parallel axis A (i.e., in a radial direction). "Fingers" as provided herein are defined elongated structures that generally extend or stand radially in relation to the shaft 32. The fingers 34 are provided to assist in moving shredded materials adjacent the outlet 22, such as shredded materials that may nest near walls of or lower side 26 of the outlet 22, or even near or between cutter elements 18. In some embodiments, the fingers 34 are structures that are flexible or resilient. For example, a single bendable or resilient finger may be provided. Here, a plurality of fingers 34 are provided on rotatable device 30. The fingers 34 are fixed in position on the shaft so as to rotate with the shaft 32. Thus, when the shaft 32 is activated or rotated about axis A, the fingers 34 rotate about axis A.

The terms "radial" or "perpendicular" when used with respect to the fingers are not to be taken as requiring a perfect or true radial or perpendicular direction. Instead, having a perpendicular or radial extent or vector sufficient to project the fingers from the shaft for performing their function is within the meanings of these terms. Likewise, the fingers need not be straight and may have curved or other shapes.

Generally, the fingers 34 comprise an elongate shape that is capable of at least partially extending into the bin 14 as well as into the shredder mechanism 16 or the cutter elements 18. In some embodiments, the fingers 34 are provided about the shaft 32 such that they extend in a number of different directions or angles. In some embodiments, the fingers may be formed or added to the shaft 32 in a helical manner. In some embodiments, the plurality of fingers 34 comprises bristles which are fixed in position on the shaft so as to rotate with the shaft. In some cases, a plurality of fingers may be referred to as bristles or a brush, and therefore the term "fingers" should not be limiting. Fingers 34 may be made from any number of resilient materials, such as elastic or rubber, for example. In some embodiments, the fingers 34 or bristles may be made from a synthetic nylon or similar material.

Figure 5:
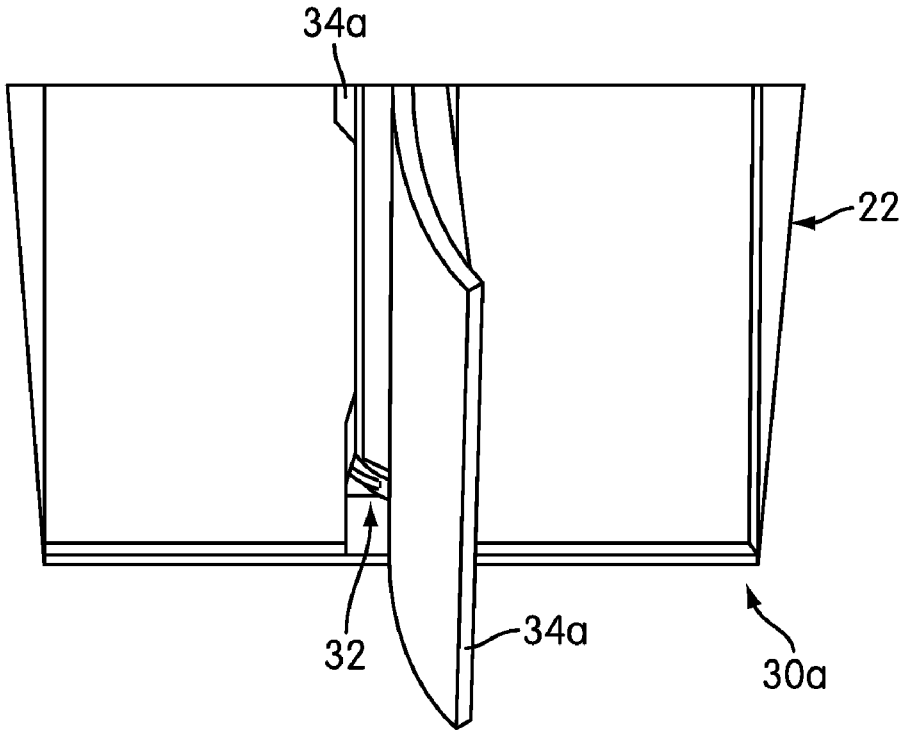
FIG. 5 is a bottom perspective view of an outlet opening on a lower side of a shredder housing of a shredder illustrate a rotatable device in an open position accordance with an embodiment of the present invention.
Figure 6:
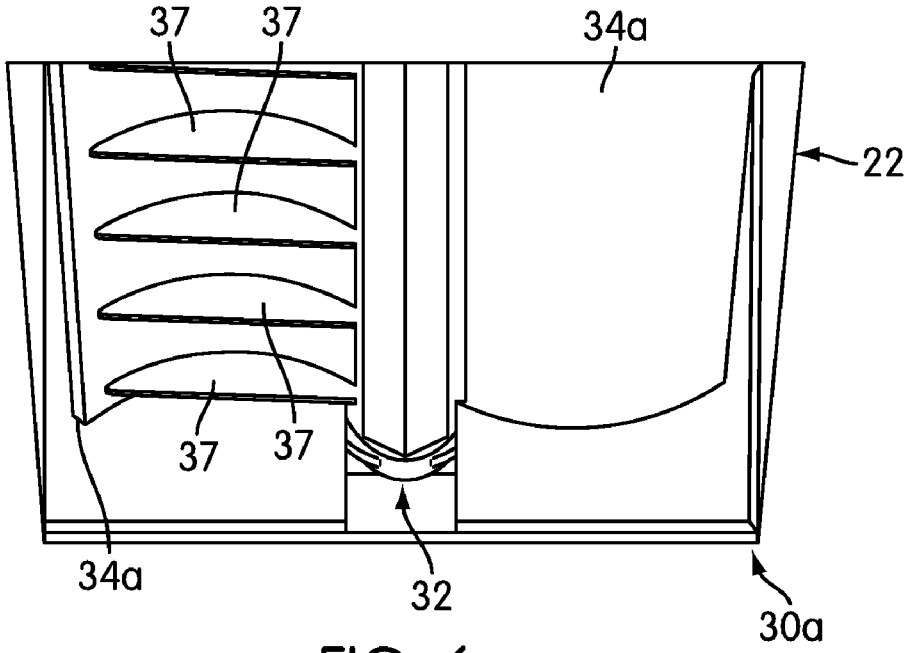
FIG. 6 is a bottom perspective view of the rotatable device of FIG. 5 in a closed position accordance with an embodiment of the present invention.

As shown in FIGS. 5 and 6, it is envisioned in some embodiments that the rotatable device 30 may include larger or wider devices such as fins 34*a* or paddles, for example, in place of alternating fingers or bristles, acting as a brush or device for moving shredded particles adjacent the outlet 22. Fins 34*a* have a generally curved or rounded shape; however, the shape of the fins 34*a* should not be limiting. For example, fins 34*a* may comprise an elongate shape that extends at least partially along the axis A of the shaft 32 of the rotatable device 30. In some embodiments, two or more fins 34*a* may be provided to rotate about the shaft 32. As shown in FIG. 6, two fins 34*a* are attached or formed along axis A of the rotatable device 30 and extend from the shaft 32. The fins 34*a* may comprise a width that is substantially similar to a length of the shaft (e.g., a length along the axis). The fins 34*a* may also comprise a length that is substantially similar to an inside dimension of the outlet 22 or bottom receptacle 25. In some cases, the length of the fins 34*s* allows it to extend such that it is still able to rotate into at least a part of the outlet 22 and extend at least partially into the bin 14. In any case, the fins 34*a* are designed such that they are able to move shredded particles adjacent the outlet 22.

In an embodiment, fins 34*a* may comprise additional devices or vanes 37, which may be formed during manufacture and/or provide additional stability to the rotatable device 30. Fins 34*a* may also be made from any number of materials. For example, fins 34*a* may be formed from an elastic or rubber material, or from a substantially rigid material, such as plastic. Should the fins 34*a* have some flexibility or resiliency, vanes 37 may assist in providing some structural stability about its length and width.

Besides assisting in moving shredded material adjacent the outlet 22, fins 34*a* also assist in reducing shredded materials from falling out of the outlet 22 during emptying. More specifically, the fins 34*a* of the rotatable device may be oriented in a closed position to substantially prevent shredded materials from being discharged from the outlet by "closing" the outlet 22 when the shredder housing 12 and bin 14 are moved out of an operative position relative to each other. When waste bins 14 or containers are typically emptied, the cutting elements 18 of shredder mechanism 16 may have shredded materials (e.g., particles of waste or trash) caught therein (e.g., which may cause bird nesting). Thus, when the bin 14 is moved, the shredder mechanism 16 may be agitated and the particles originally stuck in the cutting elements 18 may become dislodged and fall into a housing of an outer frame and/or the area surrounding the shredder 10 (e.g., the floor). Users or consumers using shredders having a pull out waste bin in particular do not expect this type of mess and difficulty when emptying the bin. In particular, users do not want waste particles falling when the bin is not in a position to catch them (i.e., when the bin 14 is not under the shredder housing 12). However, the fins 34*a* may address this type of annoying waste particle mess problem by preventing the shredded materials (waste) in or adjacent the shredder mechanism 16 from being discharged from the outlet 22 during a waste bin emptying process.

Figure 7:
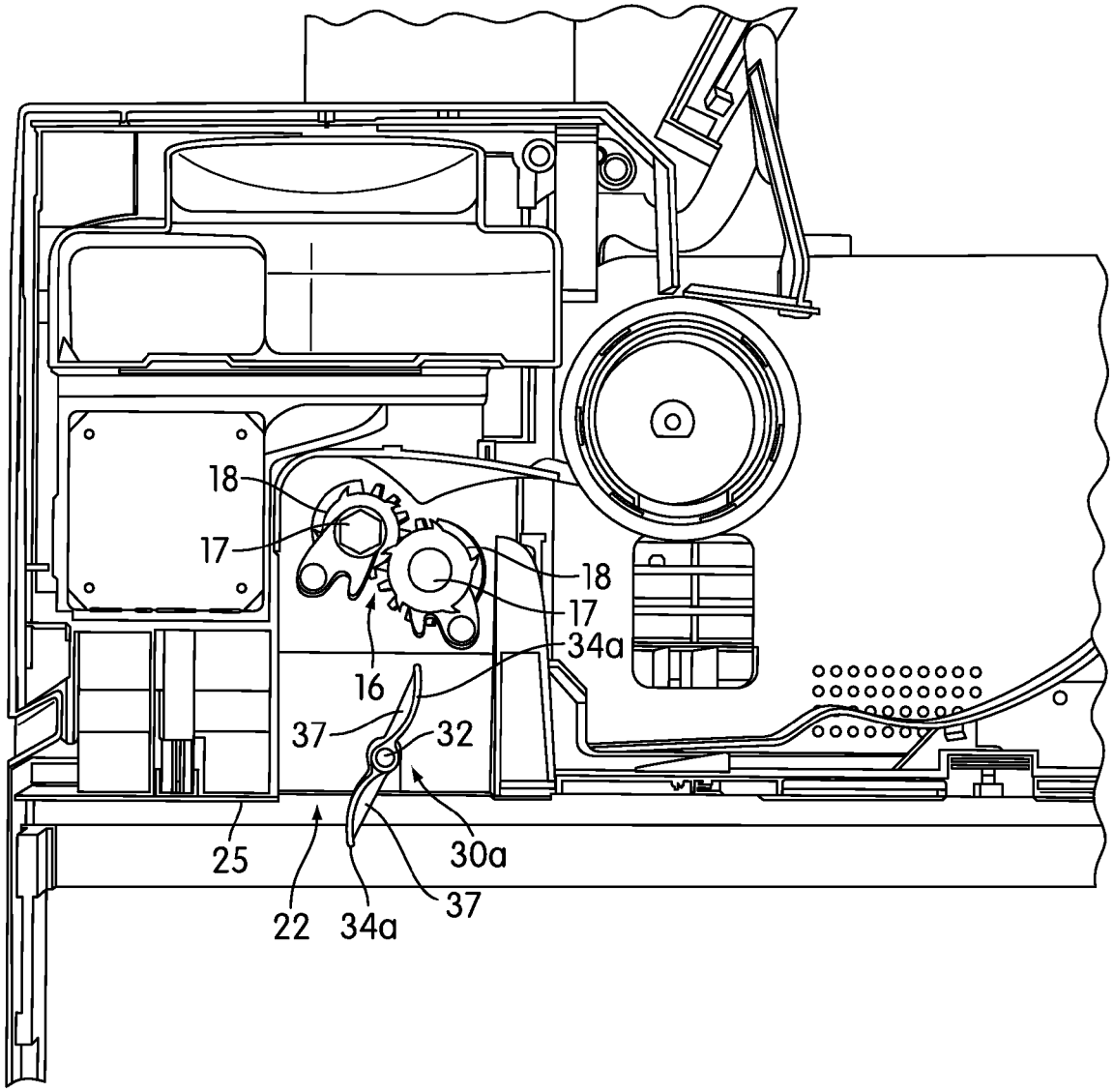
FIGS. 7 and 8 show cross-sectional side views of an inside of a shredder housing of a shredder having the rotatable device of FIGS. 5 and 6, respectively.
Figure 8:
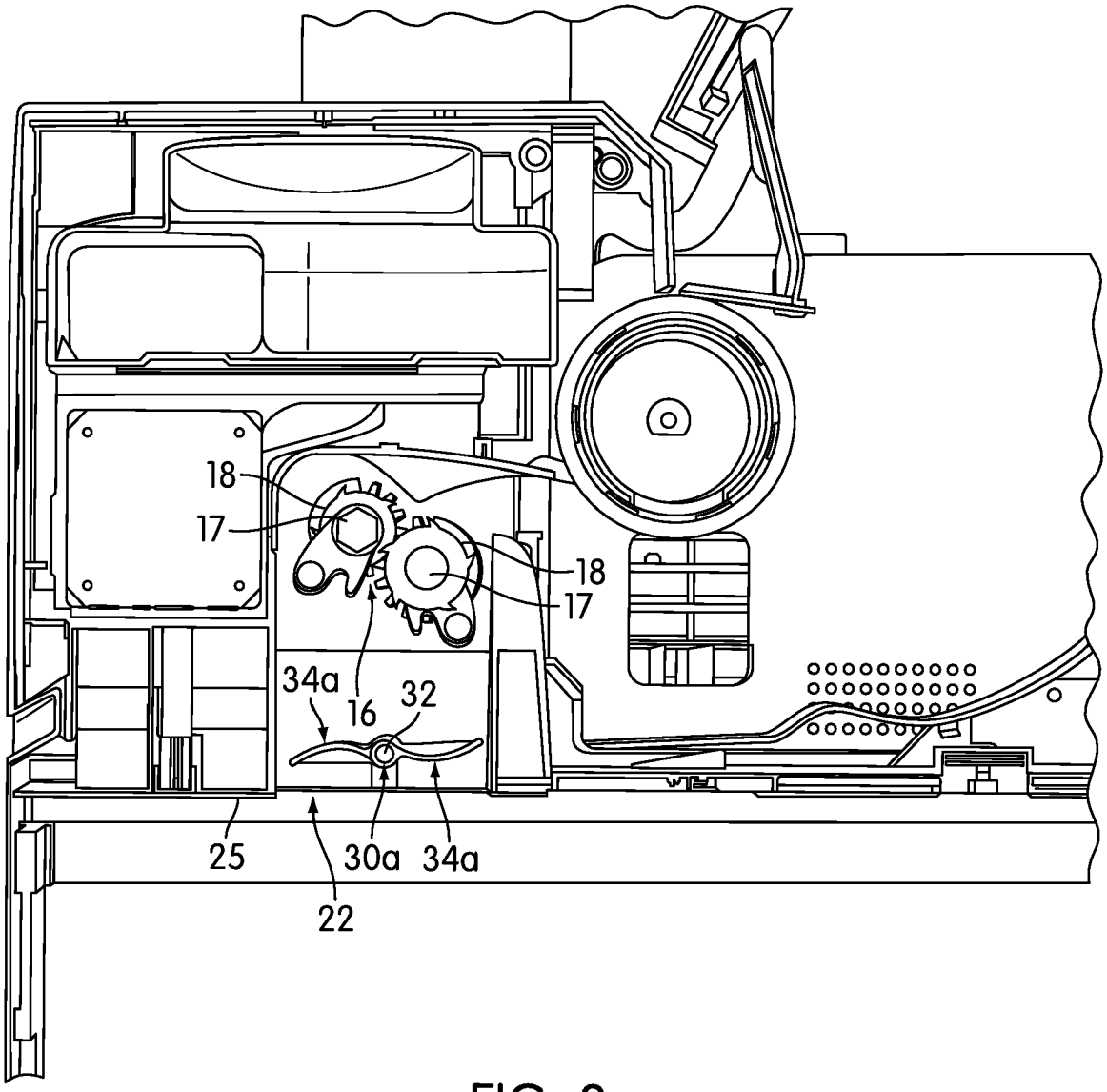

Specifically, the fins 34*a* of the rotatable device 30 may be positioned in relation to the outlet 22 such that they are in an open position or a closed position. FIGS. 7 and 8 show cross-sectional side views of an inside of a shredder housing of a shredder having a rotatable device 30 with fins 34 in open and closed positions, respectively. An open position is defined as a first position wherein the fins 34*a* are positioned in the outlet 22 or bottom receptacle 25 without substantially blocking shredded materials from being discharged therefrom, i.e., allowing shredded materials to be deposited into the container or waste bin, such as shown in FIGS. 5 and 7. A closed position is defined as a second position wherein the fins 34*a* are positioned such that they are substantially covering the outlet 22 of the shredder housing 12 to prevent shredded materials from being discharged therefrom, such as shown in FIGS. 6 and 8 (e.g., across the outlet). As an option, the fins may extend for the entire or substantially the entire length of the outlet so that particles do not escape between individual fingers. Additional description regarding activation and positioning of the rotatable device 30 is provided below.

Also, by moving the fins 34*a* into a closed position in the outlet 22 as shown in FIG. 8, damage to the fins 34*a* (e.g., from the user hitting the fins 34*a* with an edge of the bin 14) is also prevented. Further, it should be noted that, for illustrative purposes only, the fins 34*a* of the device 30 as shown in FIGS. 7 and 8 do not extend between the cutter elements 18. However, it is envisioned that the width of the fins 34*a* may be formed such that at least an edge or a series of individual projections of the fin 34*a* substantially contacts or intrudes between the cutter elements 18 in an embodiment.

The rotation of the rotatable device 30 may be activated in any number of ways. In some embodiments, the rotation may be activated manually. For example, a switch may be provided which triggers a motor to start rotation of the rotatable device 30. In some embodiments, the rotation of the rotatable device 30 may be activated automatically. In this case, "automatically" activating rotation refers turning or rotating the shaft 32 of the device 30 at the time or detection of a predetermined event or occurrence. For example, the rotation may be associated with the activation of the shredder mechanism 16. The rotatable device 30 may also be activated to rotate concurrently with the cutter elements 18 of the cutting assembly (e.g., such as when motor 23 is used to rotate both the shredder mechanism 16 and the rotatable device 30). In some embodiments, the rotation of the rotatable device 30 is associated with a power switch for turning on the shredder 10. As an option, a positional sensor, such as a Hall sensor, may be used to detect and control the rotational position of the device 30.

In some embodiments, the rotation of the rotatable device 30 may be associated with one or more sensing devices 36 of the shredder 10, such as "bin full" sensors. The shredder 10 may comprise at least one sensor 36 to detect a presence of shredded materials in relation to the rotatable device 30, or in relation to the shredder housing 12 and/or mechanism 16. The sensor(s) 36 may be provided on the lower side 26 of the shredder housing 12 as shown in FIG. 3. Additionally or alternatively, the sensor(s) may be provided on a side of the bin 14 or in a manner so as to detect an accumulation of shredded materials or particles within the walls of the bin 14. In some embodiments, one or more sensor(s) 36 may be provided to activate the rotation of the shaft 32 of the rotatable device 30 upon the detection of the presence of shredded materials. In some embodiments, one or more sensor(s) 36 may communicate with a controller to activate the rotatable device 30 upon reaching or exceeding a predetermined threshold. For example, one such threshold may be upon detection of a level of the shredded materials, e.g., when the bin 14 is detected as full, or detects the accumulation of shredded particles in a pile 28. The rotatable device 30 may be activated when shredded materials or particles have accumulated to a predetermined capacity (e.g., of 90 percent full), or when the shredded materials appear to be within a predetermined distance below the lower side 26 of the housing 12 (e.g., 2 to 3 inches from the housing 12).

In some embodiments, the rotatable device 30 may also be implemented in conjunction with a plurality of bin full detectors such as sensors 36 to rotate in a specific direction based on the level of shredded material detected in the waste bin 14. In such an implementation, the plurality of sensors 36 may be positioned on the lower side 26 of the shredder housing 12 so as to detect characteristics associated with the pile 28 of shredded materials. For example, the sensors 36 may assist in determining a slope of the pile 28 or its highest position of accumulation. The device 30 may then be activated to rotate in such a way so as to move the shreds from the peak of the pile 28, to either toward a front or back or left or right side(s) of the bin 14 of the shredder 10, depending on the accumulation characteristics in the bin 14. Thus, the rotatable device 30 may more efficiently distribute the shredded material inside the bin 14.

In some embodiments, such as when the shaft 32 is rotated by a separate motor, a rotary sensing device may be associated with the rotatable device 30. Such a rotary sensing device may be used to verify that the device 30 rotates to a predetermined position (e.g., a horizontal position). For example, as shown in FIGS. 7 and 8, the rotatable device 30 may be rotated to a stop such that its fins 34*a* are provided in a specific position. Generally, the fins 34*a* of the rotatable device 30 are designed to rotate when activated and be in a substantially open position when the shredder 10 is enabled and in an operative position ready for use. However, the rotatable device 30 may be rotated by a separate motor and stopped such that the fins 34*a* are in a substantially closed position when the shredder power is off and/or when it is detected that the bin 14 is being moved relative to the shredder housing 12. That is, when the bin 14 is pulled away from the shredder housing or outwardly from a frame (i.e., out of an operative position relative to the shredder housing 12), the fins 34*a* are stopped when in a horizontal direction, so that they could catch any shredded particles that may fall from the cutter elements 18. Thus, the rotary sensing device would detect whether the fins 34*a* are positioned correctly to stop shredded materials.

Figure 4:
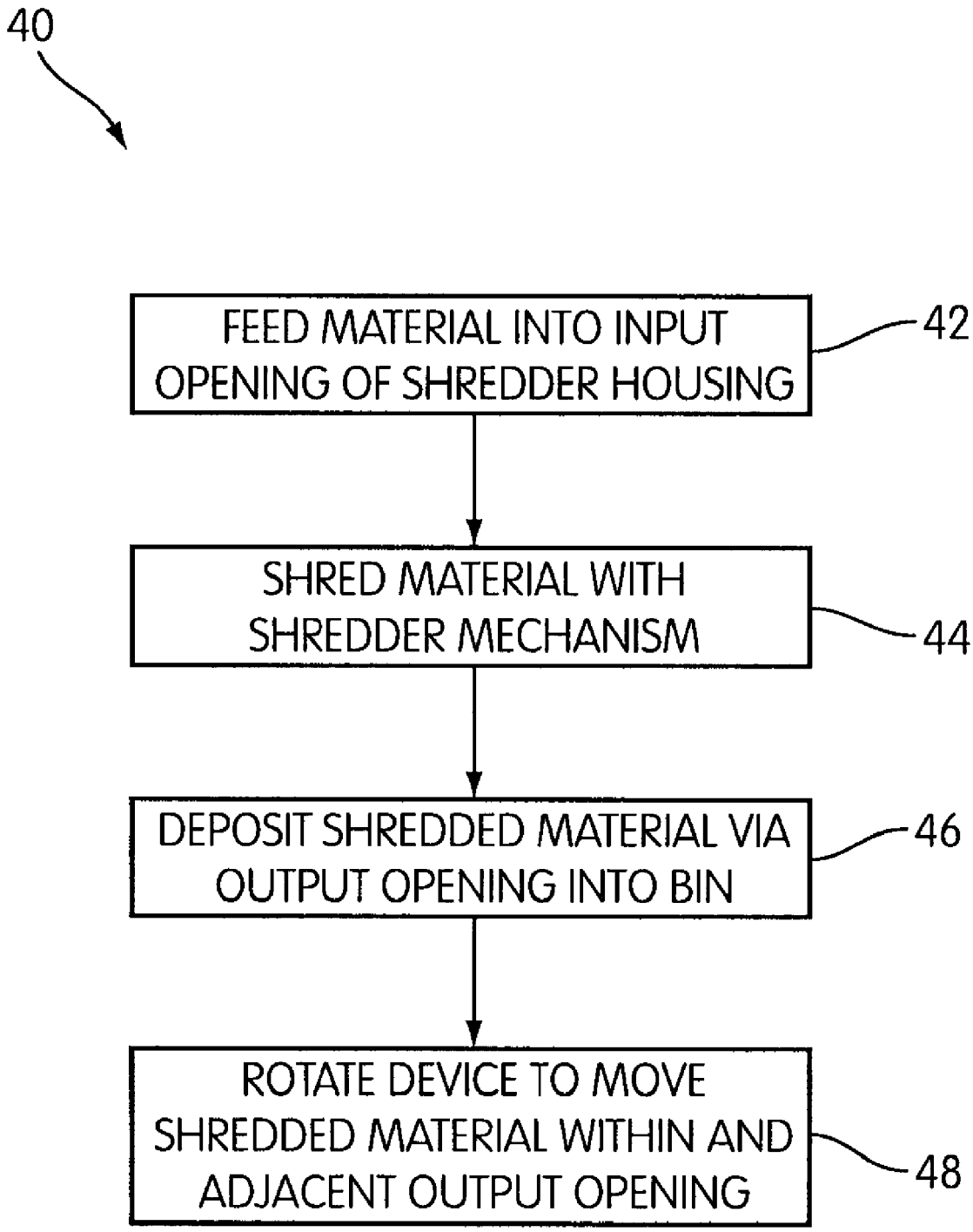
FIG. 4 is a flow chart diagram illustrating a method for moving shredded materials in a shredder in accordance with an embodiment of the present invention.

FIG. 4 provides a flow chart diagram illustrating a method 40 for moving shredded materials in a shredder 10 in accordance with an embodiment of the present invention. Step 42 provides feeding material into an input opening or throat 22 of the shredder housing 12. The material is then shredded using the shredder mechanism 16, indicated at step 44. As the shredded material is deposited via the output opening or outlet 22 and into bin 14, as indicated at step 46, the rotatable device is rotated, at step 48, to move shredded material positioned within and adjacent the output opening 22. Material positioned within and adjacent the output opening or outlet 22 may be material near the opening 22, such as bird nested particles 120, or material that has accumulated in a pile 28 in bin 14, for example. Material positioned within and adjacent the output opening 22 may also include shredded or partially shredded materials or particles that are in the shredder mechanism 16 or cutter elements 18.

Figure 1:
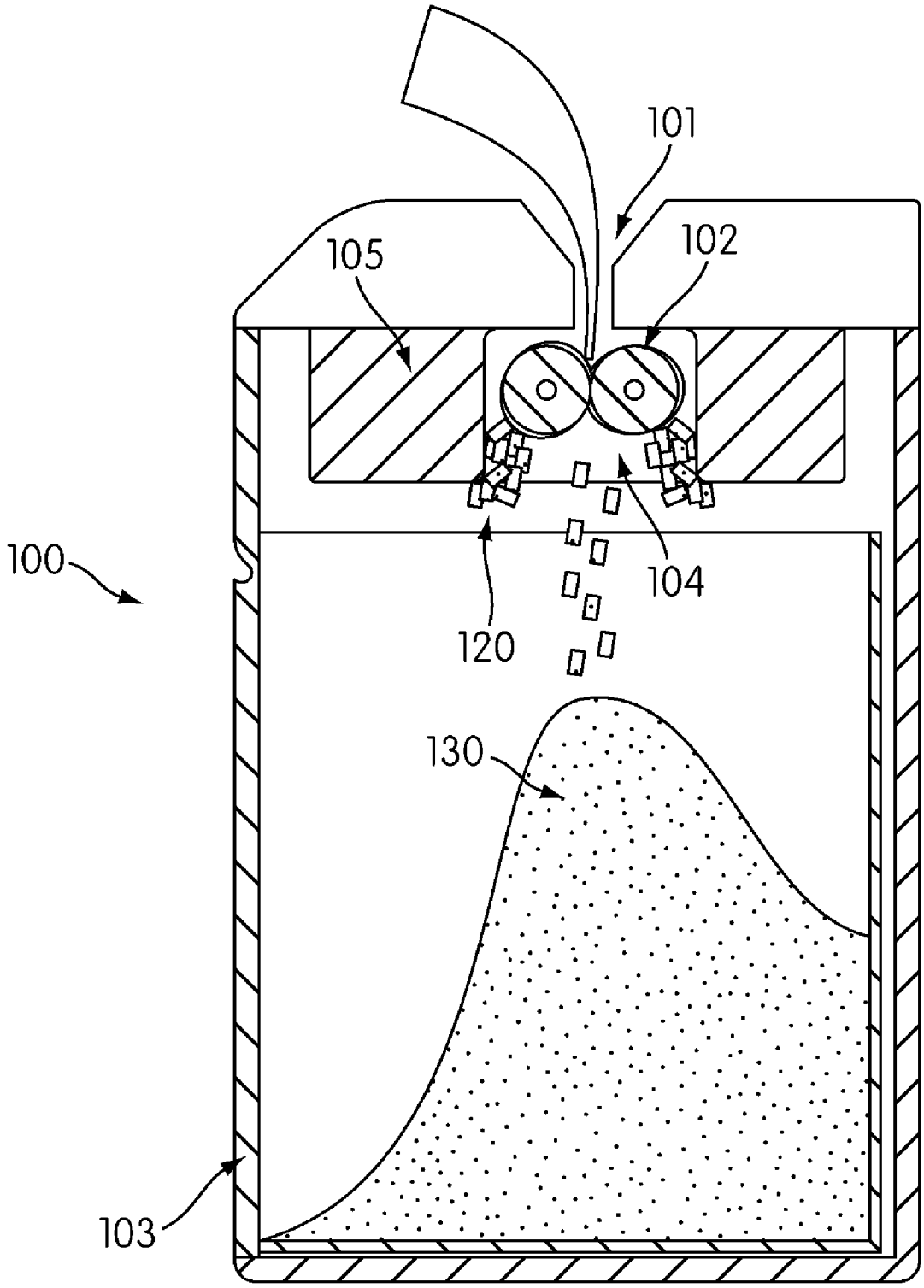
FIG. 1 PRIOR ART
FIG. 1 is a cross-sectional view of a shredder of the prior art.

The rotatable device 30 is designed to alleviate both bird-nesting 120 and crowning 130 problems in shredders, as discussed with reference to FIG. 1 above. As the fingers 34 of the rotatable device 30 are rotated below the shredder mechanism 16, they perform multiple functions. For example, the resiliency or flexibility of the fingers 34 enables them to enter between cutter elements 18 (see FIG. 2) and dislodge any shredded material (e.g., paper particles) caught in or around the cutting assembly. This effectively dislodges any bird-nesting particles from between the cutter elements 18 and around the shredder mechanism 16 and outlet 22 to increase smooth shredding operation. It also assists in reducing or eliminating false bin full alerts detected by one or more sensors.

In addition, as the fingers 34 are rotated they also engage and disperse shredded materials entering or accumulating in the bin 14. Thus, the rotating device may act as a raking device, so that a pile 28 may be leveled and a more even pile may be formed in the bin 14. This allows the bin 14 to more effectively fill to capacity, as well as reduce premature bin full alerts detected by sensors, that may require user attention.

It should be noted that the position of the rotatable device 30 (or its rotating shaft 32) below the shredder mechanism 16 contributes to providing the above-noted benefits. The rotatable device 30 is able to perform two functions using a single device. Additionally, the rotatable device 30 as described herein rotates in a circular motion, rather than a reciprocal motion as provided in the prior art. This is advantageous because the rotatable device 30 is able to assist in cleaning shredded materials from the underside of the shredder mechanism 16 and/or cutting assembly, as well as near the lower side 26 of the shredder housing 12 (e.g., such as in the bin 14). Moreover, the rotating shaft design improves upon reciprocal or sliding shaft designs because it reduces the risk of device or its bristles from becoming jammed by stray particles, and possibly malfunctioning.

Also, the positioning of the fingers 34 from the surface 33 of the shaft 32 should not be limited. In some embodiments, the fingers 34 may be designed to extend from the shaft 32 in a diagonal or angled relationship with respect to axis A. The design or shape of the fingers 34 also should not be limiting. For example, the fingers or bristles may be designed in any manner such that they are able to at least partially extend into the bin as well as into the shredder mechanism 16. The fingers may have a rounded, angled, polygonal, or elongate shape. Also, the fingers 34 may be added to shaft 32 or manufactured with shaft 32 so as to form a uniform assembly. Alternatively, as previously noted, other shaped devices, such as paddles or elongated shapes, and other configurations, such as extending along or around the shaft 32, may be used and are not beyond the scope of this disclosure.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a bin for receiving shredded materials;

a shredder housing having a shredder mechanism mounted therein, the shredder housing comprising an input opening for receiving materials and an output opening for depositing shredded material into the bin, the output opening being open to a bottom of the shredder housing;

the shredder mechanism including a motor and a cutter assembly, the motor rotating the cutter assembly about an axis to shred materials fed therein, and a rotatable device positioned at least partially between the shredder mechanism and a bottom of the output opening, the rotatable device comprising a shaft having a plurality of elongated structures having a direction of elongation extending at least partially radially with respect to an axis of the shaft, and wherein the shaft is configured to rotate about an axis parallel to the axis of the cutter elements so as to move shredded materials within and adjacent the output opening.

2. A shredder according to claim 1, wherein the shaft of the rotatable device is positioned below the shredder mechanism.

3. A shredder according to claim 1, wherein the shaft of the rotatable device is rotated in a clockwise direction or a counterclockwise direction.

4. A shredder according to claim 1, wherein the shaft of the rotatable device is mounted within the shredder housing or within the shredder mechanism.

5. A shredder according to claim 1, wherein the shaft of the rotatable device is driven by the motor rotating the cutter assembly.

6. A shredder according to claim 1, wherein the plurality of elongated structures are resilient.

7. A shredder according to claim 6, wherein the elongated structures comprise bristles which are fixed in position on the shaft so as to rotate with the shaft.

8. A shredder according to claim 1, wherein the plurality of elongated structures are made from an elastic or rubber material.

9. A shredder according to claim 1, wherein the elongated structures of the rotatable device extend into the cutter assembly so as to move shredded materials caught in or around the cutter assembly within the output opening.

10. A shredder according to claim 9, wherein the elongated structures of the rotatable device extend at least partially into the bin.

11. A shredder according to claim 10, wherein the elongated structures of the rotatable device are configured to engage and move an accumulation of shredded materials in the bin adjacent the output opening.

12. A shredder according to claim 1, wherein the elongated structures of the rotatable device extend at least partially into the bin.

13. A shredder according to claim 12, wherein the elongated structures of the rotatable device are configured to engage and move an accumulation of shredded materials in the bin adjacent the output opening.

14. A shredder according to claim 1, wherein the plurality of elongated structures comprise fins which are fixed in position on the shaft so as to rotate with the shaft.

15. A shredder according to claim 1, wherein the rotatable device is mounted on a lower side of the shredder housing.

16. A shredder according to claim 1, wherein the rotation of the rotatable device is manually activated by a switch.

17. A shredder according to claim 1, wherein the shredder further comprises at least one sensor to detect a presence of shredded materials in relation to the device so as to activate the rotation of the shaft of the rotatable device upon the detection of the presence of shredded materials.

18. A shredder according to claim 1, wherein the shredder further comprises a plurality of sensors to determine a slope of an accumulation of shredded materials in the bin.

19. A shredder according to claim 18, wherein the rotatable device is rotated in a direction so as to distribute the accumulation of shredded materials in the bin based on the determined slope.

20. A shredder according to claim 1, wherein the rotation of the rotatable device is activated upon activation of the cutting assembly.

21. A shredder according to claim 20, wherein the rotation of the rotatable device is activated to rotate concurrently with the cutting assembly.

22. A method for moving shredded materials in a shredder, the method comprising:

feeding material to be shredded into an input opening in a shredder housing of the shredder, the shredder housing being provided on a bin for receiving shredded materials;

shredding the material with a shredder mechanism mounted in the shredder housing, the shredder mechanism including a motor and a cutter assembly, the motor rotating the cutter assembly about an axis to shred materials fed therein;

depositing the shredded material via an output opening in the shredder housing into the bin, the output opening being open to a bottom of the shredder housing; and rotating a shaft of a rotatable device about an axis that is parallel to the axis of the cutter elements, the shaft of the rotatable device having a plurality of elongated structures having a direction of elongation extending at least partially radially with respect to an axis of the shaft so as to move shredded material within and adjacent the output opening, and wherein the rotatable device is positioned at least partially between the shredder mechanism and a bottom of the output opening.

23. A method according to claim 22, wherein the shaft of the rotatable device is rotated in a clockwise direction or a counterclockwise direction.

24. A method according to claim 22, wherein the elongated structures of the rotatable device extend into the cutter assembly so as to move shredded materials caught in or around the cutting assembly within the output opening.

25. A method according to claim 24, wherein the elongated structures of the rotatable device extend at least partially into the bin.

26. A method according to claim 25, wherein the elongated structures of the rotatable device are configured to engage and move an accumulation of shredded materials in the bin adjacent the output opening.

27. A method according to claim 22, wherein the elongated structures of the rotatable device extend at least partially into the bin.

28. A method according to claim 27, wherein the elongated structures of the rotatable device engage and move an accumulation of shredded materials in the bin adjacent the output opening.

29. A method according to claim 22, further comprising detecting a presence of shredded materials in relation to the rotatable device and activating the rotation of the shaft of the rotatable device upon the detection of the presence of shredded materials.

30. A method according to claim 29, wherein the detection includes determining a height of a pile of shredded materials in the bin.

31. A method according to claim 22, wherein the rotating the shaft of the rotatable device is activated with the shredding the material.

32. A method according to claim 22, wherein the rotating the shaft of the rotatable device is activated to rotate concurrently with the cutting assembly.

33. A shredder comprising:

a bin for receiving shredded materials;

a shredder housing having a shredder mechanism mounted therein, the shredder housing comprising an input opening for receiving materials and an output opening for depositing shredded material into the bin, the output opening being open to a bottom of the shredder housing;

the shredder mechanism including a motor and a cutter assembly, the motor rotating the cutter assembly about an axis to shred materials fed therein, and a rotatable device positioned at least partially between the shredder mechanism and a bottom of the output opening, the rotatable device comprising a shaft having a plurality of elongated structures having a direction of elongation extending at least partially radially with respect to an axis of the shaft, wherein the shaft is configured to rotate about an axis parallel to the axis of the cutter elements so as to move shredded materials adjacent the output opening, and wherein the shaft of the rotatable device is configured to position the elongated structures in an open position or a closed position in relation to the output opening, the open position allowing the shredded material to be deposited from the output opening and the closed position preventing the shredded materials from being deposited therefrom.

34. A shredder according to claim 33, wherein the elongated structures are positioned in the closed position when the bin is in out of an operative position relative to the shredder housing.

35. A shredder comprising:

a bin for receiving shredded materials;

a shredder housing having a shredder mechanism mounted therein, the shredder housing comprising an input opening for receiving materials and an output opening for depositing shredded material into the bin, the output opening being open to an output side of the shredder housing;

the shredder mechanism including a motor and a cutter assembly, the motor rotating the cutter assembly about an axis to shred materials fed therein, and a rotatable device positioned at least partially between the shredder mechanism and an output side of the output opening, the rotatable device comprising a shaft having a plurality of radially extending structures extending at least partially radially with respect to an axis of the shaft, and wherein the shaft is configured to rotate about an axis parallel to the axis of the cutter elements so as to move shredded materials within and adjacent the output opening.

36. A shredder according to claim 35, wherein the shaft of the rotatable device is mounted within the shredder housing or within the shredder mechanism.

37. A shredder according to claim 35, wherein the shaft of the rotatable device is driven by the motor rotating the cutter assembly.

38. A shredder according to claim 35, wherein the plurality of radially extending structures are resilient.

39. A shredder according to claim 38, wherein the radially extending structures comprise bristles which are fixed in position on the shaft so as to rotate with the shaft.

40. A shredder according to claim 35, wherein the plurality of radially extending structures are made from an elastic or rubber material.

41. A shredder according to claim 35, wherein the radially extending structures of the rotatable device extend into the cutter assembly so as to move shredded materials caught in or around the cutter assembly within the output opening.

42. A shredder according to claim 41, wherein the radially extending structures of the rotatable device extend at least partially into the bin.

43. A shredder according to claim 42, wherein the radially extending structures of the rotatable device are configured to engage and move an accumulation of shredded materials in the bin adjacent the output opening.

44. A shredder according to claim 35, wherein the radially extending structures of the rotatable device extend at least partially into the bin.

45. A shredder according to claim 44, wherein the radially extending structures of the rotatable device are configured to engage and move an accumulation of shredded materials in the bin adjacent the output opening.

46. A method for moving shredded materials in a shredder, the method comprising:

feeding material to be shredded into an input opening in a shredder housing of the shredder, the shredder housing being provided on a bin for receiving shredded materials;

shredding the material with a shredder mechanism mounted in the shredder housing, the shredder mechanism including a motor and a cutter assembly, the motor rotating the cutter assembly about an axis to shred materials fed therein;

depositing the shredded material via an output opening in the shredder housing into the bin, the output opening being open to an output side of the shredder housing; and rotating a shaft of a rotatable device about an axis that is parallel to the axis of the cutter elements, the shaft of the rotatable device having a plurality of radially extending structures extending at least partially radially with respect to an axis of the shaft so as to move shredded material within and adjacent the output opening, and wherein the rotatable device is positioned at least partially between the shredder mechanism and an output side of the output opening.

47. A method according to claim 46, wherein the radially extending structures of the rotatable device extend into the cutter assembly so as to move shredded materials caught in or around the cutting assembly within the output opening.

48. A method according to claim 47, wherein the radially extending structures of the rotatable device extend at least partially into the bin.

49. A method according to claim 48, wherein the radially extending structures of the rotatable device are configured to engage and move an accumulation of shredded materials in the bin adjacent the output opening.

50. A method according to claim 46, wherein the radially extending structures of the rotatable device extend at least partially into the bin.

51. A method according to claim 50, wherein the radially extending structures of the rotatable device engage and move an accumulation of shredded materials in the bin adjacent the output opening.

52. A method according to claim 46, wherein the rotating the shaft of the rotatable device is activated with the shredding the material.

53. A method according to claim 52, wherein the rotating the shaft of the rotatable device is activated to rotate concurrently with the cutting assembly.

54. A shredder comprising:

a bin for receiving shredded materials;

a shredder housing having a shredder mechanism mounted therein, the shredder housing comprising an input opening for receiving materials and an output opening for depositing shredded material into the bin, the output opening being open to an output side of the shredder housing;

the shredder mechanism including a motor and a cutter assembly, the motor rotating the cutter assembly about an axis to shred materials fed therein, and a rotatable device positioned at least partially between the shredder mechanism and an output side of the output opening, the rotatable device comprising a shaft having a plurality of radially extending structures extending at least partially radially with respect to an axis of the shaft, wherein the shaft is configured to rotate about an axis parallel to the axis of the cutter elements so as to move shredded materials adjacent the output opening, and wherein the shaft of the rotatable device is configured to position the radially extending structures in an open position or a closed position in relation to the output opening, the open position allowing the shredded material to be deposited from the output opening and the closed position preventing the shredded materials from being deposited therefrom.

55. A shredder according to claim 35, wherein the rotation of the rotatable device is activated upon activation of the cutting assembly.

56. A shredder according to claim 55, wherein the rotation of the rotatable device is activated to rotate concurrently with the cutting assembly.

57. A shredder according to claim 54, wherein the radially extending structures are positioned in the closed position when the bin is in out of an operative position relative to the shredder housing.

* * * * *